US007220099B2

(12) United States Patent
Bekrenev et al.

(10) Patent No.: US 7,220,099 B2
(45) Date of Patent: May 22, 2007

(54) SEALING ARRANGEMENT FOR A ROTOR OF A TURBO MACHINE

(75) Inventors: Igor A. Bekrenev, Moscow (RU); Arkadi Fokine, Moscow (RU); Frank Hummel, Nussbaumen (CH); Igor Ossipov, Moscow (RU); Sergey Trifonov, Moscow (RU)

(73) Assignee: ALSTOM Technology Ltd., Baden (CH)

( * ) Notice: Subject to any disclaimer, the term of this patent is extended or adjusted under 35 U.S.C. 154(b) by 217 days.

(21) Appl. No.: 11/008,988

(22) Filed: Dec. 13, 2004

(65) Prior Publication Data

US 2005/0129525 A1 Jun. 16, 2005

Related U.S. Application Data

(63) Continuation of application No. PCT/IB03/50186, filed on May 21, 2003.

(30) Foreign Application Priority Data

Jun. 11, 2002 (EP) ..... 02405479

(51) Int. Cl.
*F01D 11/00* (2006.01)

(52) U.S. Cl. ..... 415/173.7; 415/174.3; 416/174

(58) Field of Classification Search ..... 415/173.7, 415/174.2, 174.3, 174.5, 199.5; 416/174, 416/193 A, 198 A, 248
See application file for complete search history.

(56) References Cited

U.S. PATENT DOCUMENTS 3,572,966 A 3/1971 Borden et al.
4,184,689 A 1/1980 Brodell et al.

(Continued)

FOREIGN PATENT DOCUMENTS

DE 26 03 867 6/1977

(Continued)

OTHER PUBLICATIONS

Search Report from EP 02 40 5479 (Nov. 13, 2002).

(Continued)

*Primary Examiner*—Edward K. Look
*Assistant Examiner*—Devin Hanan
(74) *Attorney, Agent, or Firm*—Cermak & Kenealy, LLP; Adam J. Cermak

(57) ABSTRACT

A sealing arrangement for a rotor of a turbomachine includes a blade (2), a heat shield (3, 4) and a sealing element (5, 6) for sealing between the blade (2) and the heat shield (3, 4) when the blade (2), heat shield (3, 4) and sealing element (5, 6) are assembled for use in the rotor. The heat shield (3, 4) includes a first slot (7, 8) for accommodating a first member (11, 12) of the sealing element (5, 6), and a root portion of the blade (2) includes a second and third slot (9, 10) for accommodating a second member (13, 14) of the sealing element (5, 6). The first slot (7, 8) extends in a direction which is substantially mutually perpendicular to a direction in which the second and third slot (9) extends, and the first member (11, 12) extends in a direction which is substantially mutually perpendicular to a direction in which the second member (13, 14) extends.

19 Claims, 3 Drawing Sheets

U.S. PATENT DOCUMENTS

| | | | | |
|---|---|---|---|---|
| 4,251,986 | A | 2/1981 | Thompson et al. | |
| 4,330,234 | A | 5/1982 | Colley | |
| 4,484,858 | A | 11/1984 | Kurosawa et al. | |
| 4,872,312 | A | 10/1989 | Iizuka et al. | |
| 5,445,499 | A * | 8/1995 | Charbonnel | 416/220 R |
| 5,709,530 | A * | 1/1998 | Cahill et al. | 415/170.1 |
| 5,749,218 | A * | 5/1998 | Cromer et al. | 60/796 |
| 6,499,945 | B1 * | 12/2002 | Lathrop | 416/198 A |
| 7,101,147 | B2 * | 9/2006 | Balsdon | 415/135 |

FOREIGN PATENT DOCUMENTS

| | | |
|---|---|---|
| EP | 0 263 002 A1 | 4/1988 |
| GB | 706730 | 4/1954 |
| GB | 905582 | 9/1962 |
| GB | 2 102 897 A | 2/1983 |
| WO | 97/01695 | 1/1997 |
| WO | 03/104617 A1 | 12/2003 |

OTHER PUBLICATIONS

IPER from PCT/EP 03/50186 (Mar. 9, 2004).
Search Report from PCT/EP 03/50186 (Oct. 2, 2003).

* cited by examiner

SEALING ARRANGEMENT FOR A ROTOR OF A TURBO MACHINE

This application is a Continuation of, and claims priority under 35 U.S.C. § 120 to, International Application number PCT/IB03/50186, by the inventors hereof, filed 21 May 2003, and claims priority to EPO application number 02405479.3, filed 11 Jun. 2002, the entireties of both of which are incorporated by reference herein.

BACKGROUND OF THE INVENTION

1. Field of the Invention

This invention relates to a sealing arrangement for a rotor of a turbomachine. More particularly, but not exclusively, the invention relates to a sealing arrangement which can be used in the rotor of a gas turbine.

2. Brief Description of the Related Art

It is a recognised problem that gases can leak from the flow channels formed by component parts, such as blade roots and heat shields, of a rotor in a turbomachine. The effects of such leakage will depend upon the type of turbomachine, but include: unnecessary heating, a loss of strength, mechanical failure, a loss of efficiency and a need for undesirably expensive materials.

It is well known to address the foregoing problems by the use of sealing elements, which often take the form of plates mounted between the component parts. In a typical arrangement, a portion of each plate is inserted into a slot made in the root part of a blade and another portion is inserted into a slot made in an adjacent heat shield.

Whilst such arrangements have been successful in reducing gas leakage, they suffer from a disadvantage that the slots in the adjacent component parts need to be provided at the same radial level and implementation of this precondition requires the component parts to be manufactured to within extremely narrow tolerances. It is further the case that the relative positions of the slots can change during operation of the turbomachine, due to the influences of high temperatures and centrifugal forces, with the effect that a plate can be subject to shear or to fracture.

To compensate for this mutual displacement of the slots, it is known to make the slots sufficiently wider than the thickness of the sealing plates. However, in this case, the plates are positioned in their slots with a significant skew and this results in unsatisfactorily high levels of leakage past the seal. When many joints are provided between individual sealing elements in the circumferential direction, the number of potential leakage paths tends to increase, with the effect that the problem is particularly exacerbated.

SUMMARY OF THE INVENTION

The present invention sets out to increase the effectiveness of seals between the component parts of the rotor of a turbomachine, as well as to allow a greater freedom of relative motion between these component parts.

Accordingly a first aspect of the invention provides a sealing arrangement for a rotor of a turbomachine.

Exemplarily, a first member and a first slot are each arranged so as to extend in both a substantially axial direction and a substantially circumferential direction when the rotor is assembled for use. Further exemplarily, a second and a third slot and second member are each arranged so as to extend in both a substantially radial direction and a substantially circumferential direction when the rotor is assembled for use.

In another exemplary embodiment, a sealing element is configured such that, when the rotor is assembled for use, the sealing element has a circumferential length which is substantially equal to the blade pitch of the said rotor or substantially equal to a multiple of the blade pitch of the said rotor.

The sealing element may be provided with a friction-reducing coating.

A second aspect of the invention provides a sealing element for a rotor of a turbomachine, the said sealing element defining a ring segment and being generally T-shaped in cross-section.

The sealing element may include a first member adapted for axial orientation within a rotor, when installed for use, and a second member adapted for radial orientation within a rotor, when installed for use. It may also be provided with a friction reducing coating.

According to a third aspect of the invention, there is provided a blade for a rotor of a turbomachine, the said blade including a blade root, the blade root being provided with a first and second slot which are adapted to extend substantially radially when the blade is installed in a rotor so as to accommodate a radially extending member of a sealing element, the first radial slot extends in a direction which is substantially opposite to a direction in which the said second radial slot extends.

According to a fourth aspect of the invention, there is provided a rotor for a turbomachine.

Exemplarily, each first member and each first slot are arranged so as to extend in both a substantially axial direction and a substantially circumferential direction. It can be further advantageous that each second and third slot and each second member are arranged so as to extend in both a substantially radial direction and a substantially circumferential direction when the rotor is assembled for use.

In another exemplary embodiment, each sealing element has a circumferential length which is substantially equal to the blade pitch of the said rotor or substantially equal to a multiple of the blade pitch of the said rotor.

Each sealing element may be provided with a friction-reducing coating.

The sealing elements may be advantageously positioned so that the circumferential positions of junctions between mutually adjacent sealing elements do not correspond with the circumferential positions of junctions between mutually adjacent blades and/or heat shields. In this regard, it can be particularly advantageous that the sealing elements are positioned such that there is a substantially maximum mismatch between the circumferential positions of junctions between mutually adjacent sealing elements and the circumferential positions of junctions between mutually adjacent blades and/or heat shields.

According to a fifth aspect of the invention, there is provided a process for the manufacture of a rotor for a turbomachine.

It can be advantageous that the first and/or second sealing elements are positioned so that the circumferential positions of junctions between mutually adjacent sealing elements do not correspond with the circumferential positions of junctions between mutually adjacent blades and/or heat shields.

It can also be advantageous that the first and/or second sealing elements are positioned such that there is a substantially maximum mismatch between the circumferential positions of junctions between mutually adjacent sealing elements and the circumferential positions of junctions between mutually adjacent blades and/or heat shields.

The provision of such slots and correspondingly configured projections on the sealing element provides two degrees of freedom, because the arrangement accommodates both axial and radial movement between adjacent component parts. This in turn allows the minimum gap at the connection between the components and sealing elements to be minimized, thereby leading to a more fluid-tight seal. It is further the case that centrifugal forces in the running engine contribute to the effect by pressing the sealing element against a side of the slot in which it is situated, thereby improving the tightness of the connection and the security of the seal still further. It is further the case that the relative characteristics of the blade, heat shield and sealing elements facilitate a highly efficient and effective manufacturing process.

BRIEF DESCRIPTION OF THE DRAWINGS

Embodiments of the invention will now be described by way of example and with reference to the accompanying drawings in which.

The drawings show only the parts important for the invention. Same elements will be numbered in the same way in different drawings.

DETAILED DESCRIPTION OF EXEMPLARY EMBODIMENTS

Figure 1:
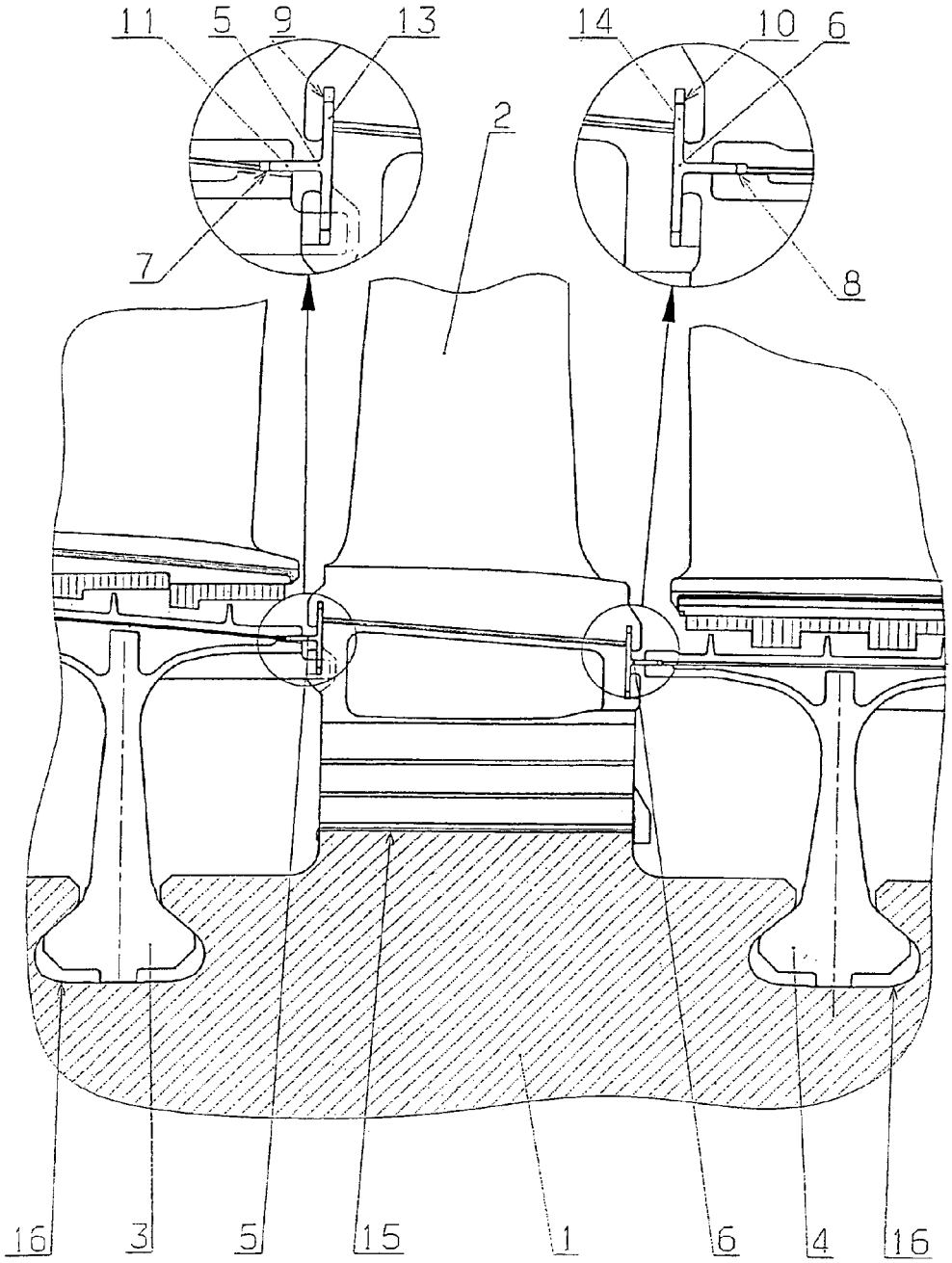
FIG. 1 is a longitudinal section through a portion of a rotor containing a sealing arrangement in accordance with the invention.

FIG. 1 shows part of a rotor defining an embodiment of the invention. The arrangement includes a rotor shaft 1, upon which are mounted a rotor blade 2 and heat shields 3, 4. This arrangement is replicated along the length of the rotor and around its circumference, however the following discussion will initially concentrate on the illustrated part for the sake of clarity.

Figure 2:
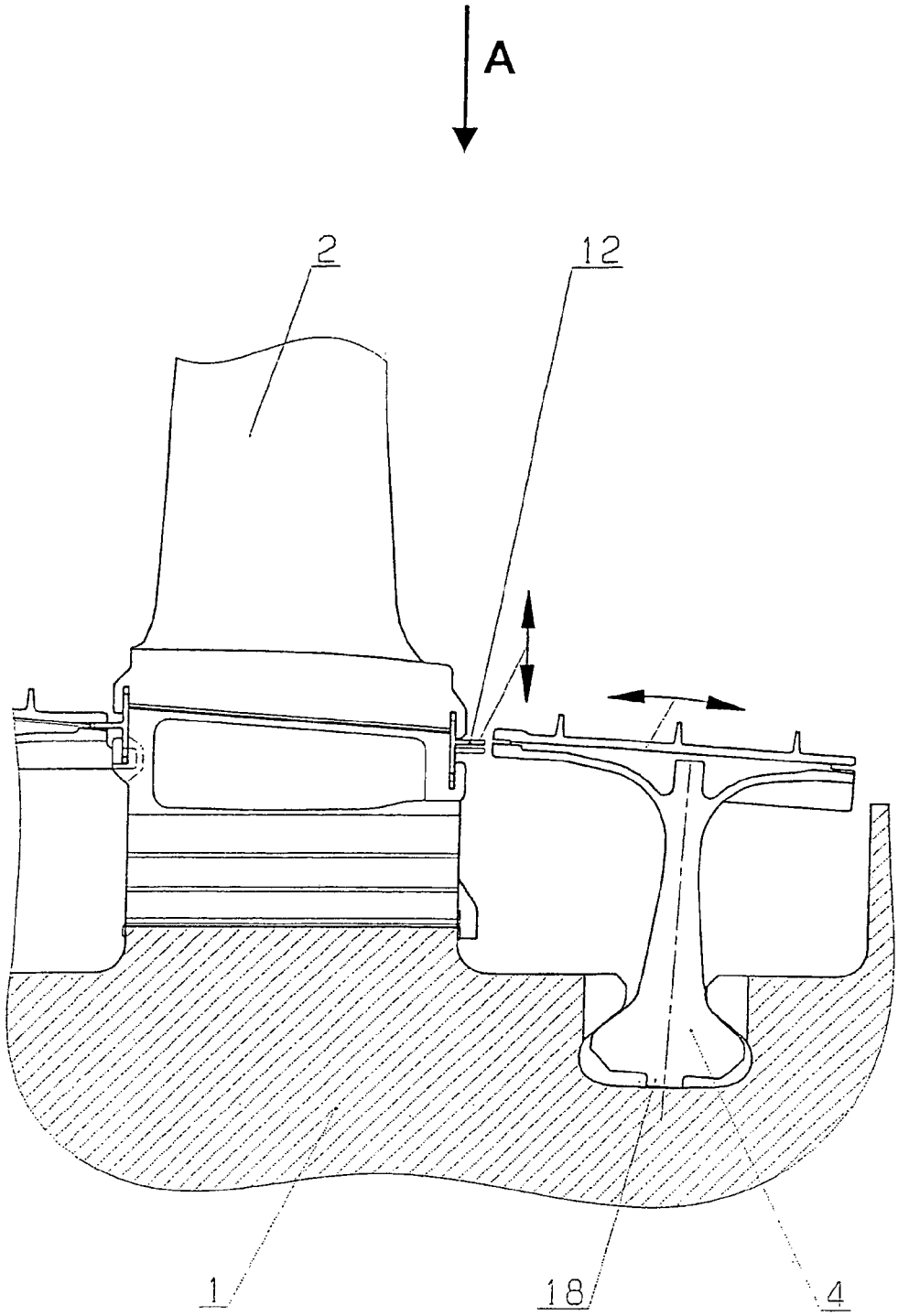
FIG. 2 is a view corresponding to FIG. 1 and illustrating the manner in which the heat shield can be mounted on to the rotor.

Each heat shield 3, 4 includes a root body portion 18 which is generally triangular in cross section, with radiussed corners. The slot 15, 16 for accommodating the root body is correspondingly configured, but of larger dimensions, so that the root body portion 18 may rock, to a limited degree, in the axial direction within the slot 16, as shown in FIG. 2. The shape and configurations of the blade and heat shields and their respective root portions are generally complex, but known. For this reason, they will not be described further in detail. The portions of the structure which are predominantly significant in defining this embodiment of the invention are illustrated in close-up form in FIG. 1, to which reference is now directed.

The expansion gap between the blade 2 and each heat shield 3, 4 is sealed by a respective sealing element 5, 6. Each sealing element is somewhat T-shaped in cross-section and arcuate to conform with the radius of curvature of the rotor at the radial location at which it is located during use. The sealing elements 5, 6 may, therefore, be considered segments of a ring in which the cross-bar of the 'T' is aligned radially and the stem of the 'T' is aligned radially. In the assembled state illustrated in FIG. 1, each sealing element 5, 6 is accommodated within a respective radially and circumferentially extending slot 9, 10 provided within the blade 2 and a respective axially and circumferentially extending slot 7, 8 provided in the adjacent heat shield 3, 4. To conform with the slots, each sealing element is arranged with a respective radially extending member 13, 14 provided in a respective one of the radially and circumferentially extending slots 9, 10, and a respective axially extending member 11, 12 which is accommodated within a respective axially and circumferentially extending slot 7, 8.

The radial extent of each radially extending member 13, 14 is less than the radial extent of the respective slot 9, 10 in which it is contained. Similarly, the axial extent of each axially extending member 11, 12 is less than the axial extent of the slot 7, 8 in which it is accommodated. As a consequence of this configuration, relative radial movement between the blade 2 and the heat shields 3, 4 can be accommodated by movement of the axially extending members 11, 12, within their respective slots 7, 8. Similarly, relative radial movement between the blade 2 and the heat shields 3, 4 can be accommodated by movement of the radially extending members 13, 14 within their respective radially extending slots 9, 10. The arrangement therefore has two degrees of freedom of movement, making it possible for the sealing elements 5, 6 to take up any one of a range of intermediate positions between the slots 9, 10 provided in the blade 2 and the slots 7, 8 provided in the heat shields 3, 4 both during assembly and in operation.

In order to reduce friction between the sealing elements and the contact surfaces of the slots in which they are provided, a friction-reducing surface coating can be applied to the sealing elements, or one or both of the slots, if desired.

Figure 3:
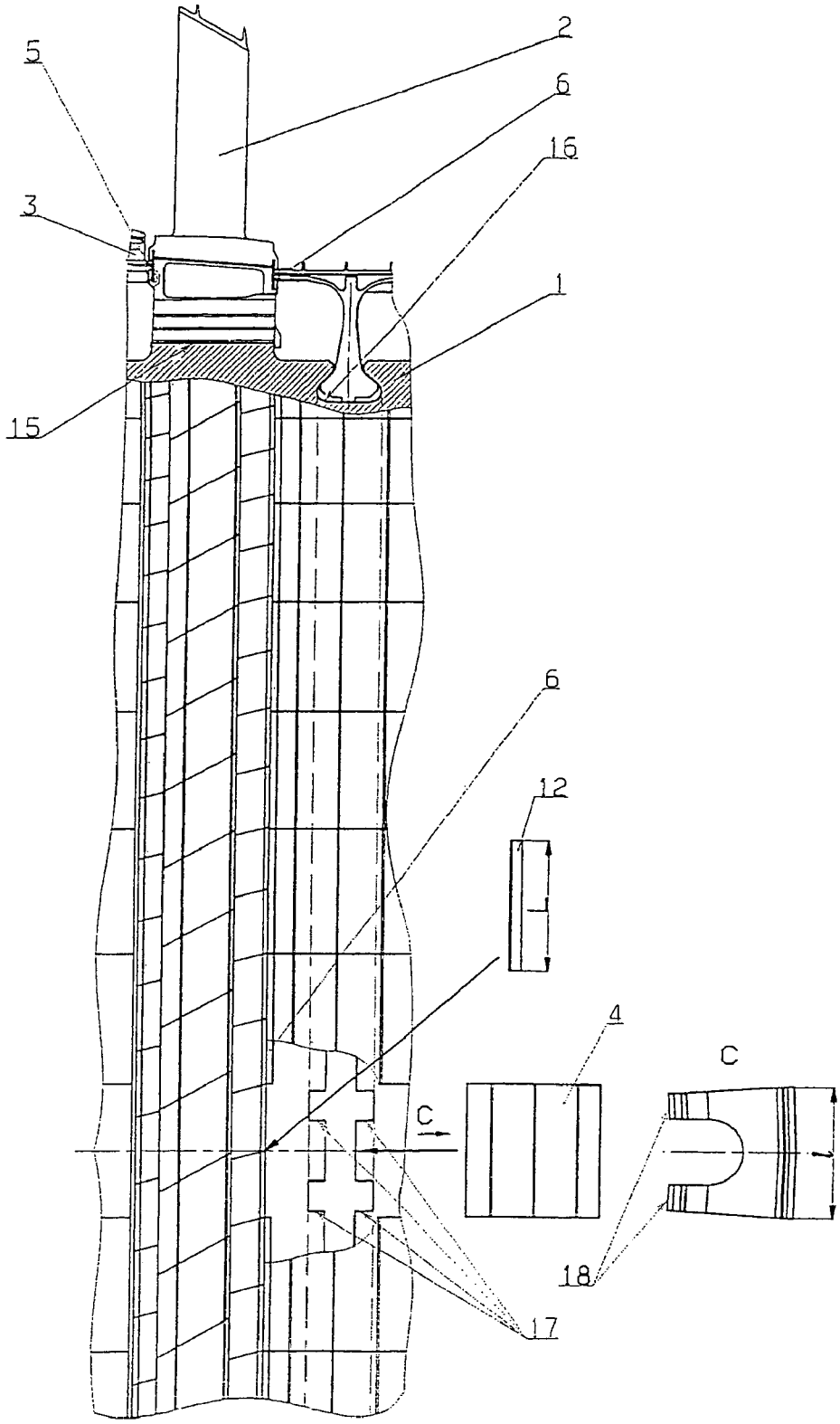
FIG. 3 is a partial cut-away view in the direction A of FIG. 2.

Assembly of the rotor will now be described with reference to FIGS. 2 and 3.

Initially, the first row of heat shields 3 (shown to left of FIG. 1) is mounted onto the rotor shaft 1. The blades 2 are next mounted onto the rotor shaft 1, and a gap corresponding to the pitchwise length L (two pitches, see FIG. 3) of a single sealing element is left at a predetermined position, although several such gaps could be left at different positions around the circumference, if preferred. It is furthermore not necessary for the pitch-wise length of the sealing elements to be two pitches, so in alternative embodiments, the gap could correspond with just a single blade or several blades, depending upon whichever length is chosen for the sealing element.

Each sealing element 5 to be fitted between the first row of heat shields 3 and the blades 2, is installed via the gap. In this regard, the axially extending member 11 of the sealing element 5 is fitted into the respective axially extending slot 7 immediately adjacent the gap and then slid circumferentially in such a manner as to introduce its radially extending member 13 into the radially extending slot 9 of the first blade root that lies adjacent the gap. Once a sufficient number of sealing elements 5 to correspond with the number of installed blades 2 have been fitted, sealing elements 6 are attached to the opposite axial side of the row of blade 2 via the gap in a similar fashion, although there is no row of heat shields into which they should be fitted on this side of the row of blades 2, at this point in time.

Because two blades 2 were omitted from the blade row in order to form the gap, the last sealing elements 5, 6 still remain to be inserted into the blade root slots 7, 8 of these omitted blades 2. These sealing elements 5, 6 are therefore fitted to the appropriate opposite sides of the omitted blades 2 using the respective radial slots 9, 10 provided in these blades 2 and the resulting arrangement, which defines a completion assembly, is then fitted into the gap together. The sealing elements 5, 6 on both sides of the blade row are subsequently moved to positions around the circumference wherein the gaps between adjacent blade platforms and the gaps between adjacent sealing elements have a maximum mismatch, so as to reduce leakage paths.

Finally, the second row of heat shields 4 (shown to the right of FIG. 1) is built by installing the heat shields 4 through respective local grooves 17 at one or more locations and moving them circumferentially to respective final positions. Once in position, each heat shield 4 is rocked towards the adjacent sealing element 6 as shown in FIG. 2, so as to accommodate the axially projecting member 12 of the sealing element 6 in the axial slot 8 of the heat shield as it addresses it. If preferred, however, the heat shield 4 need not be couple with a single sealing element 6 in this way. This is because the ability to move the heat shields 4 circumferentially and the shapes of the axially projecting member 12 and the slots 8 together mean that the heat shield 4 may initially be coupled with more than one adjacent sealing element 6 and subsequently adjusted circumferentially; indeed, the coupling may even be effected before any circumferential movement of the heat shield 4 takes place.

Following the assembly of the second ring of heat shields 4, the next row of blades can be fitted to the rotor shaft 1 and the above process repeated.

Although the above embodiment provides the axially extending slots in the heat shields and the radially extending slots in the blade roots, the reverse arrangement (with the axially extending slots in the blade roots and the radially extending slots in the heat shields) is equally viable. Furthermore, although the axially extending members of the sealing elements extend from halfway along the radially extending members in the foregoing embodiment, this need not be the case and other configurations may be particularly useful where there are constraints upon the locations of the slots in the heat shields and blade roots.

The ability to accommodate relative movement between the heat shields and blades results from the two degrees of freedom afforded by the arrangement rather than the precise orientation of the two directions of possible movement. It is therefore the case that the members of the sealing elements and the accommodating slots do not necessarily need to be aligned with the axial and radial directions.

Reference Numbers
Rotor shaft
Rotor blade
Heat shield
Heat shield
Sealing element
Sealing element
Slot
Slot
Slot
Slot
Member
Member
Member
Member
Slot
Slot
Groove
Root body portion While the invention has been described in detail with reference to exemplary embodiments thereof, it will be apparent to one skilled in the art that various changes can be made, and equivalents employed, without departing from the scope of the invention. Each of the aforementioned documents is incorporated by reference herein in its entirety.

What is claimed is:

1. A sealing arrangement for a rotor of a turbomachine, the arrangement comprising:

a blade, a heat shield, and a sealing element configured and arranged for sealing between the blade and the heat shield when the blade, the heat shield, and the sealing element are assembled for use in the rotor;

wherein the sealing element comprises a first member and a second member;

wherein the heat shield comprises a first slot for accommodating the first member of the sealing element;

wherein the blade includes a root portion having a second slot and a third slot for accommodating the second member of the sealing element;

wherein the first slot extends in a direction substantially mutually perpendicular to a direction in which the second slot and the third slot extend;

wherein the second slot extends in a direction substantially opposite to a direction in which the said third slot extends; and wherein the first member extends in a direction substantially mutually perpendicular to a direction in which the second member extends.

2. A sealing arrangement according to claim 1, wherein the first member and the first slot are each arranged to extend in both a substantially axial direction and a substantially circumferential direction when the rotor is assembled for use.

3. A sealing element according to claim 1, wherein the second member and the second slot and the third slot are each arranged to extend in both a substantially radial direction and a substantially circumferential direction when the rotor is assembled for use.

4. A sealing arrangement according to claim 1, wherein the sealing element is configured and arranged such that, when the rotor is assembled for use, the sealing element has a circumferential length which is substantially equal to the blade pitch of the rotor or substantially equal to a multiple of the blade pitch of the rotor.

5. A sealing arrangement according to claim 1, wherein the sealing element comprises a friction-reducing coating.

6. A sealing arrangement according to claim 1, wherein the sealing element comprises a ring segment generally T-shaped in cross-section.

7. A sealing arrangement according to claim 6, wherein the first member is configured and arranged for axial orientation within a rotor, when installed for use; and wherein the second member is configured and arranged for radial orientation within a rotor, when installed for use.

8. A sealing arrangement according to claim 6, wherein the sealing element further comprises a friction reducing coating.

9. A blade for a rotor of a turbomachine, the blade comprising:

a blade root provided with a first slot and a second slot which are both adapted to extend substantially radially when the blade is installed in a rotor so as to accommodate a radially extending member of a sealing element;

wherein the first radial slot extends in a direction substantially opposite to a direction in which the second radial slot extends.

10. A rotor for a turbomachine, the rotor comprising:

a rotor shaft, a plurality of blades mounted on the rotor shaft in an annular row, a plurality of heat shields mounted on the rotor shaft in an annular row, and a plurality of sealing elements for sealing between the blades and the heat shields;

wherein each sealing element includes a first member and a second member;

wherein the heat shields each comprise a first slot for accommodating a first member of said sealing elements;

wherein each blade includes a root portion comprising a second slot and a third slot for accommodating a second member of said sealing elements;

wherein each first slot extends in a direction substantially mutually perpendicular to a direction in which said second slot and third slot in an immediately adjacent heat shield extends;

wherein each said second slot extends in a direction substantially opposite to a direction in which a third slot extends; and wherein each first member extends in a direction substantially mutually perpendicular to a direction in which a second member provided on the same sealing element extends.

11. A rotor according to claim 10, wherein each first member and each first slot are arranged so as to extend in both a substantially axial direction and a substantially circumferential direction.

12. A rotor according to claim 10, wherein each second slot, each third slot, and each second member is arranged so as to extend in both a substantially radial direction and a substantially circumferential direction when the rotor is assembled for use.

13. A rotor according to claim 10, wherein each sealing element has a circumferential length substantially equal to the blade pitch of the rotor or substantially equal to a multiple of the rotor blade pitch.

14. A rotor according to claim 10, wherein each sealing element comprises a friction-reducing coating.

15. A rotor according to claim 10, wherein the plurality of sealing elements are positioned so that circumferential positions of junctions between mutually adjacent sealing elements do not correspond with circumferential positions of junctions between mutually adjacent blades, heat shields, or both.

16. A rotor according to claim 15, wherein the plurality of sealing elements are positioned such that there is a substantially maximum mismatch between the circumferential positions of junctions between mutually adjacent sealing elements and the circumferential positions of junctions between mutually adjacent blades, heat shields, or both.

17. A process for the manufacture of a rotor for a turbomachine, the process comprising:

(i) fitting a plurality of first heat shields to a rotor shaft at a common first axial location, so that the first heat shields define an annular row;

(ii) fitting a plurality of blades to the rotor shaft at a second common axial location, so that the blades are arranged in an annular row with a circumferential gap of one or more blade pitches between a predetermined two of said blades;

(iii) successively installing a plurality of first sealing elements between said row of blades and said row of first heat shields, including inserting a generally axially extending member of each first sealing element into a generally axially extending slot of a first heat shield which is axially adjacent said gap in the blades, and subsequently circumferentially sliding said generally axially extending member, so as to introduce a generally radially extending member thereof into first and second generally radially extending slots provided in one of said predetermined two of the blades (iv) successively installing a plurality of second sealing elements upon a side of said row of blades axially opposite to the location of said first sealing elements by introducing a generally radially extending member of each said second sealing element into third and fourth generally radially extending slots provided in one of said predetermined two of said blades;

(v) fitting one or more of said first sealing elements and one or more of said second sealing elements to respectively opposite sides of a blade or blades corresponding to said gap in order to form a completion assembly;

(vi) installing the completion assembly within said gap, to complete said row of blades; and (vii) fitting a row of second heat shields to said rotor shaft at a third common axial location so that said heat shields define an annular row, wherein at least one of said second heat shields is rocked towards said second sealing elements so as to receive a generally axially extending member of one or more of said heat shields in a generally axially extending slot in said at least one of said second heat shields during fitting.

18. A process according to claim 17, wherein said first sealing elements, said second sealing elements, or both, are positioned so that the circumferential positions of junctions between mutually adjacent sealing elements do not correspond with the circumferential positions of junctions between mutually adjacent blades, heat shields, or both.

19. A process according to claim 18, wherein said first sealing elements, said second sealing elements, or both, are positioned such that there is a substantially maximum mismatch between the circumferential positions of junctions between mutually adjacent sealing elements and the circumferential positions of junctions between mutually adjacent blades, heat shields, or both.

* * * * *